United States Patent [19]

Brown

[11] 3,966,211

[45] June 29, 1976

[54] TRAFFIC COURT BOARD GAME

[75] Inventor: Eugene B. Brown, Chicago, Ill.

[73] Assignee: Lawrence Peska Associates, Inc., New York, N.Y. ; a part interest

[22] Filed: Sept. 23, 1974

[21] Appl. No.: 508,503

[52] U.S. Cl. ..... 273/134 GM; 273/134 C; 273/134 E

[51] Int. Cl.[2] ..... A63F 3/00

[58] Field of Search ..... 273/134

[56] References Cited

UNITED STATES PATENTS

| | | | |
|---|---|---|---|
| 1,209,373 | 12/1916 | Zarker | 273/134 G |
| 2,810,578 | 10/1957 | Pacitti | 273/134 GM |

FOREIGN PATENTS OR APPLICATIONS

| | | | |
|---|---|---|---|
| 220,795 | 8/1957 | Australia | 273/13 C |
| 784,604 | 10/1957 | United Kingdom | 273/134 AC |
| 709,543 | 5/1954 | United Kingdom | 273/134 C |

*Primary Examiner*—Delbert B. Lowe
*Attorney, Agent, or Firm*—Jack D. Slobod

[57] ABSTRACT

A board game apparatus having a plurality of line indicia defining an elongated street and a plurality of blocks disposed along at least one line representing a plurality of commercial institutions. The apparatus also includes a plurality of cards having instructions for destinations and a second plurality of cards having a plurality of court dispositions. A spinner is provided for determination of sequential player moves or traffic offenses, with a plurality of playing elements which are representations of automobiles.

4 Claims, 2 Drawing Figures

TRAFFIC COURT BOARD GAME

BACKGROUND OF THE INVENTION

The field of the invention relates to board game apparatus. One of these prior art board game apparatus is the popular one entitled "Monopoly" disclosed in U.S. Pat. No. 2,026,082, issued Dec. 31, 1935. The apparatus therein does not have the particular features of the board game apparatus of this invention.

An object of the invention is to provide a board game apparatus having rules and method of play that are stimulating and require intelligence to achieve the required goal.

A further object of the invention is to provide a board game apparatus that is interesting to use and economical to manufacture.

SUMMARY OF THE INVENTION

The apparatus in accordance with the invention includes a game board having a plurality of line indicia defining an elongated street with a plurality of boxes disposed along at least one side. The boxes are identified as representing a plurality of commercial institutions and a plurality of cards are provided having instructions for destinations corresponding to the commercial institutions designated on the game board. A plurality of cards is also provided having court dispositions when the rules of playing require such disposition. Also included are means for random determination of sequential player moves which ordinarily include a spinner. Also provided are a plurality of playing elements which ordinarily will be representations of automobiles, which will in one form of the invention have depending bosses dimensioned and configured for engagement with corresponding cylindrical apertures in the game board.

BRIEF DESCRIPTION OF THE DRAWING

While the specification concludes with claims particularly pointing out and distinctly claiming the subject matter which I regard as my invention, it is believed the invention will be better understood from the following description taken in conjunction with the accompanying drawing in which:

DESCRIPTION OF A PREFERRED EMBODIMENT

Figure 1:
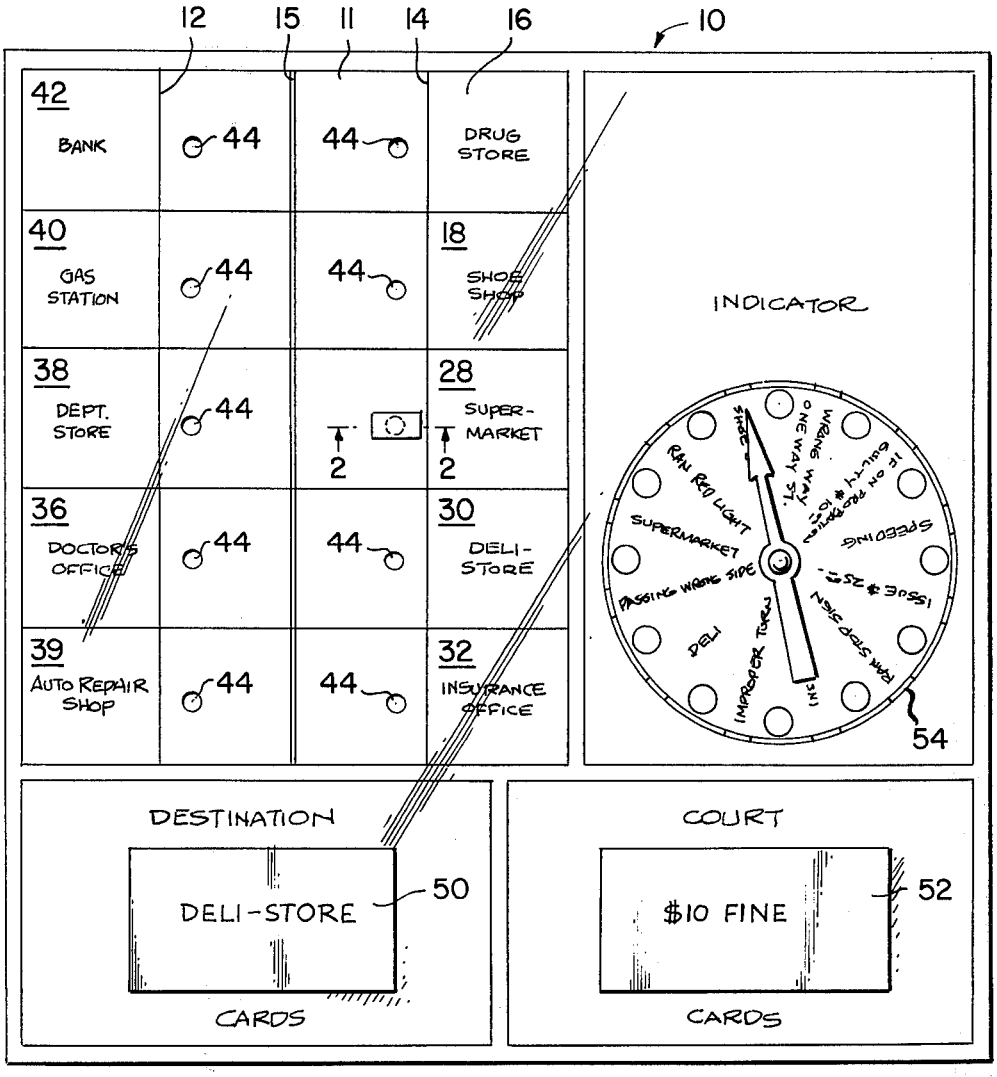
FIG. 1 is a plan view of the game board in accordance with the invention.
Figure 2:
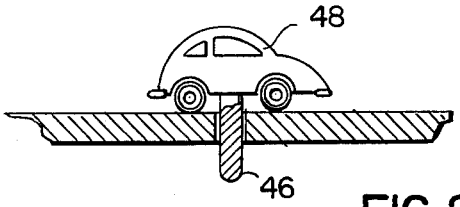
FIG. 2 is a sectional broken away view through the line 2—2 of FIG. 1.

Referring now to FIGS. 1 and 2 there is shown apparatus in accordance with the invention which comprises a game board 10. The game board 10 includes a street 11 having boundary lines 12 and 14 and center divider lines 15. Disposed along the street 11 are a plurality of rectangles which are designated as various commercial institutions. More specifically, there is a drug store 16, a shoe shop 18, a supermarket 28, a deli-store 30, an insurance office 32, an auto repair shop 39, a doctor's office 36, a department store 38, a gas station 40 and a bank 42. Disposed proximate each commercial institution is a hole 44 dimensioned and configured for engagement with a depending boss or pin 46 extending from the lower extremity of the playing element or automobile representation 48. The representations ordinarily will be similar to various automobiles which are widely recognized. Disposed elsewhere on the game board 10 is a rectangle 50 which is provided for holding a plurality of destination cards. Similarly another rectangle 52 is provided for holding a plurality of court cards. The faces of the cards in rectangles 50 and 52 are normally turned face down when the game is played. Also disposed on the board is a spinner 54 for the random selection of a variety of moves or traffic offenses. The spinner 54 has a plurality of radially extending positions disposed thereabout. The positions may include all of the commercial institutions which are disposed alongside the street 11 as well as a plurality of offenses as well as penalties and bonuses for the player who by chance has the spinner moved to the particular angular location.

In operation the object of the game is to complete the destination which is selected by drawing a card from the destination card rectangle 50. The cards disposed therein include all of the commercial institutions along street 11. In one form of the invention it is a requirement to complete the selected destination without commiting any offense designated on the spinner. The game may be played by two to four individuals. Each individual is initially issued one hundred dollars in play money. Each player then pulls in an instruction card from the stack disposed in destination card rectangle 50. The order in which these cards are drawn is not critical.

Normally by chance the sequence of the player moves are then determined and upon deciding the sequence the players sequentially spin the indicator 54 to get a selection. If the indicator moves to "Deli" then the player can move his representation 48 to the hole 44 disposed adjacent to the deli-store 30. If the indicator stops on "you have run red light" it is required that the player draw a court card and suffer whatever penalty is marked out by that card. In another form of the invention a discrete court position may be provided and the court cards will be issued by a player who is separately designated as a judge. Some of the court cards may specify that the player is on probation. Such players will be deemed guilty only if on a subsequent move the indicator stops on a position "if on probation you are now guilty — $10 fine".

The play is complete and a winner is determined if one player completes the requirements of his destination card. If two players reach their destination in the same movement cycle, then the player with the greater number of dollars after paying off fines is the winner. If a player runs out of money, that player automatically loses unless on the next move that player can spin the indicator and land on the angular location marked "Issue $25.00". In that event the player can take two more free spins immediately.

Various other changes will be apparent to those skilled in the art and it is intended that the invention be limited only by the appended claims.

Having thus described the invention, what is claimed as new is:

1. A board game apparatus having a plurality of line indicia defining an elongated street and a plurality of blocks disposed along at least one side of said street, each block having an indicia thereon designating a different one of a plurality of commercial institutions, a plurality of first cards having instructions designating different ones of said commercial institutions for determining goal board destinations, a means for random selection of one of said plurality of commercial institution indicia or one of a plurality of traffic offenses committed on said street, a plurality of second cards having indicia indicating different monetary fines, a supply of play money for players, and a plurality of playing elements each of which represents a single player for movement to said blocks having commerical institution indicia selected by said random selection means.

2. The apparatus as described in claim 1 wherein said random selection means is a pivotally mounted spinner cooperating with indicia disposed in angularly spaced relationship about said spinner for indicating different ones of said plurality of commercial institutions and said plurality of traffic offenses.

3. The apparatus described in claim 1 wherein each of said playing elements has a depending cylindrical boss and wherein said street has a hole configured and dimensioned for loose fitting engagement with said depending boss disposed adjacent to each commercial institution.

4. The apparatus as described in claim 3 wherein each of said playing elements is a representation of an automobile.

* * * * *